US009184487B2

(12) United States Patent
Moon et al.

(10) Patent No.: US 9,184,487 B2
(45) Date of Patent: Nov. 10, 2015

(54) RESONANTOR STRUCTURE FOR WIRELESS POWER TRANSFER SYSTEM

(71) Applicant: ELECTRONICS AND TELECOMMUNICATIONS RESEARCH INSTITUTE, Daejeon (KR)

(72) Inventors: Jung Ick Moon, Daejeon (KR); In Kui Cho, Daejeon (KR); Seong-Min Kim, Daejeon (KR); Je Hoon Yun, Daejeon (KR); Woo Jin Byun, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 29 days.

(21) Appl. No.: 13/912,294

(22) Filed: Jun. 7, 2013

(65) Prior Publication Data

US 2014/0125433 A1 May 8, 2014

(30) Foreign Application Priority Data

Nov. 5, 2012 (KR) ..... 10-2012-0124127
Apr. 16, 2013 (KR) ..... 10-2013-0041651

(51) Int. Cl.

| | |
|---|---|
| ***H01P 7/10*** | (2006.01) |
| ***H01P 7/00*** | (2006.01) |
| ***H01P 7/06*** | (2006.01) |
| *H01P 1/203* | (2006.01) |

(52) U.S. Cl.
CPC *H01P 7/10* (2013.01); *H01P 7/065* (2013.01); *H01P 1/20318* (2013.01)

(58) Field of Classification Search
USPC ..... 333/219–235
See application file for complete search history.

(56) References Cited

U.S. PATENT DOCUMENTS

| | | | | |
|---|---|---|---|---|
| 8,022,576 | B2 * | 9/2011 | Joannopoulos et al. | 307/104 |
| 8,552,821 | B2 * | 10/2013 | Nagai | 333/219 |
| 8,674,550 | B2 * | 3/2014 | Bohori et al. | 307/104 |
| 8,739,441 | B2 * | 6/2014 | Lowenthal et al. | 40/449 |
| 2002/0037132 | A1 * | 3/2002 | Sercel et al. | 385/30 |
| 2005/0107870 | A1 * | 5/2005 | Wang et al. | 623/1.44 |
| 2011/0193948 | A1 * | 8/2011 | Amling et al. | 348/68 |
| 2011/0315496 | A1 * | 12/2011 | Bohori et al. | 191/10 |
| 2014/0125433 | A1 * | 5/2014 | Moon et al. | 333/219.1 |

FOREIGN PATENT DOCUMENTS

| | | | |
|---|---|---|---|
| KR | 1020080024911 | A | 3/2008 |
| KR | 1020120052591 | A | 5/2012 |

* cited by examiner

*Primary Examiner* — Brandon S Cole
(74) *Attorney, Agent, or Firm* — Ladas & Parry LLP

(57) ABSTRACT

A resonator structure for a wireless power transfer system Includes resonators, which are to transfer wireless power, and a dielectric substance, which includes at least one exposure region formed on the dielectric substance to fix the resonators in a covered shape and to selectively expose parts of the resonators.

14 Claims, 8 Drawing Sheets

RESONANTOR STRUCTURE FOR WIRELESS POWER TRANSFER SYSTEM

RELATED APPLICATIONS(S)

This application claims the benefit of Korean Patent Application No. 10-2012-0124127, filed on Nov. 5, 2012 and Korean Patent Application No. 10-2013-0041651, filed on Apr. 16, 2013, which are hereby incorporated by references as if fully set forth herein.

FIELD OF THE INVENTION

The present invention relates to a resonator for a wireless power transfer system, and more particularly to a resonator structure for a wireless power transfer system, which is suitable for application to a system for transferring wireless power using magnetic resonance or an induction phenomenon.

BACKGROUND OF THE INVENTION

As is well known, a wireless power transfer system that wirelessly transfers (transmits) power (energy) uses an electrical field, a magnetic field, or an electromagnetic field, and for this, in the wireless power transfer system, the power is necessarily transferred from a resonator or an emitter to a receiver after passing through space.

In this case, a great deal of technical effort is necessary in order to reduce transfer loss, and in particular, loss related to a conductor that forms the resonator and the shape of the resonator for generating a resonance phenomenon at appropriate frequencies may be major research issues.

FIG. 1 is a structural view of an ideal resonator that can be applied to a wireless power transfer system.

Referring to FIG. 1, a resonator 100 is in a spiral shape so as to be configured as a thin film type, and has a structure in which a circular feeder root 102 is coupled to the resonator 100 for impedance matching. Here, as illustrated in FIG. 2A, the resonator 100 has a shape that is covered and fixed by a non-metal dielectric substance.

FIGS. 2A to 2C are views showing the shape in which a conductor (resonator) is fixed to the inside or the surface of a rectangular dielectric substance 104 by processing only the portion where wires are inserted into the dielectric substance 104 according to a method in the related art.

However, in the structure as illustrated in FIGS. 2A to 2C, the dielectric substance generally has an electric loss, and there is a great difference in the transfer loss of wireless power compared with the ideal structure illustrated in FIG. 1.

SUMMARY OF THE INVENTION

However, in order to configure the resonator as one portion of the wireless power transfer system, a mechanism (e.g. a jig or the like) for fixing the resonator is necessary, and the material and the shape of the fixing mechanism are as important as the resonator design.

In view of the above, the present invention proposes a resonator structure having a fixing structure that has a novel shape that can minimize transfer loss.

Further, the present invention proposes a resonator structure that is suitable for realizing smooth fixing of resonators even while properly maintaining transfer efficiency in a wireless power transfer system.

In accordance with the present invention, since the increase in the volume of the dielectric substance that fixes circular or rectangular resonators is minimized, the transfer loss of the wireless power due to the volume of the dielectric substance can be effectively reduced.

The transfer loss depending on the presence or absence of the dielectric substance in the wireless power transfer system illustrated in FIGS. 1 and 2 is shown in the following table. Accordingly, in the case in which the resonator structure proposed in the present invention is adopted, the effect of the present invention can be known more clearly.

That is, as the volume of the dielectric substance that fixes the resonators is increased, the transfer loss is increased, and thus there is a need for a minimum mechanical structure that fixes the resonators.

TABLE 1

| Calculation conditions | |
|---|---|
| Resonator 100 | Outer diameter: 30 cm, Inner diameter: 24 cm |
| Dielectric substance 104 for fixing | Relative permittivity: 3.8, Loss: 0.03 or 0.06 @ 1.8 MHz |
| Resonant frequency | 1.7 to 1.8 MHz |

[Loss Improvement Effect]

Case I) the case where only resonators and coils are present, as shown in FIG. 1:

Transfer efficiency is 95% or more, and the distance between resonators is 18 cm.

Case II) the case of being filled with a dielectric substance (loss: 0.06), as shown in FIG. 2:

Transfer efficiency is 72.69%, and the distance between resonators is 18 cm.

Case III) the case where loss is lowered to 0.03 in a dielectric substance, as shown in FIG. 2:

Transfer efficiency is 84.28%, and the distance between resonators is 18 cm.

Case IV) the case where a fixture (loss: 0.06) is configured as shown in FIG. 3:

Transfer efficiency is 78.92%, and the distance between resonators is 18 cm.

Case V) the case where a fixture (loss: 0.06) is configured as shown in FIG. 4:

Transfer efficiency is 85.77%, and the distance between resonators is 18 cm.

Case VI) the case where a fixture (loss: 0.06) is configured as shown in FIG. 5:

Transfer efficiency is 92.39%, and the distance between resonators is 18 cm.

Case VII) the case where a fixture (loss: 0.06) is configured as shown in FIG. 6:

Transfer efficiency is 87.94%, and the distance between resonators is 18 cm.

In accordance with an aspect of the exemplary embodiment of the present invention, there is provided a resonator structure for a wireless power transfer system, which includes resonators, which are to transfer wireless power, and a dielectric substance, which includes at least one exposure region formed on the dielectric substance to fix the resonators in a covered shape and to selectively expose parts of the resonators.

In the exemplary embodiment, the resonator has a circular spiral structure.

In the exemplary embodiment, the resonator is a conductor plate having a predetermined line width and line thickness.

In the exemplary embodiment, the dielectric substance has a center cavity which is formed in a center region of the spiral structure.

In the exemplary embodiment, the resonator has a rectangular spiral structure.

In the exemplary embodiment, the resonator is a conductor plate having a predetermined line width and line thickness.

In accordance with another aspect of the exemplary embodiment of the present invention, there is provided a resonator structure for a wireless power transfer system, which includes resonators, which are in a form of a rectangle to transfer wireless power, and a dielectric substance, which includes a plurality of dielectric branches that extend in outward directions based on a center of the rectangle to fix each part of the resonators in a covered form.

In the exemplary embodiment, the plurality of dielectric branches include four dielectric branches which extend in four directions based on the center.

In the exemplary embodiment, the resonator is a conductor plate of a spiral structure having a predetermined line width and line thickness.

In accordance with further another aspect of the exemplary embodiment of the present invention, there is provided a resonator structure for a wireless power transfer system, which includes resonators, which are in a form of circles to transfer wireless power, and a dielectric substance, which includes a plurality of dielectric branches that extend in diametrically opposed directions based on a center of the circle to fix each part of the resonators in a covered shape.

In the exemplary embodiment, the dielectric substance has a circular center cavity which is formed in a center region of the dielectric branches in the circle.

In the exemplary embodiment, the plurality of dielectric branches include eight dielectric branches which extend in eight directions based on the center.

In the exemplary embodiment, the resonator is a conductor plate of a spiral structure having a predetermined line width and line thickness.

BRIEF DESCRIPTION OF THE DRAWINGS

The objects and qualities of the present invention will become apparent from the following description of embodiments given in conjunction with the accompanying drawings, in which.

DETAILED DESCRIPTION OF THE EMBODIMENTS

The aspects and qualities of the present invention and methods for achieving the aspects and qualities will be apparent by referring to the embodiments to be described in detail with reference to the accompanying drawings. Here, the present invention is not limited to the embodiments disclosed hereinafter, but can be implemented in diverse forms. The matters defined in the description, such as the detailed construction and elements, are nothing but specific details provided to assist those of ordinary skill in the art in a comprehensive understanding of the invention, and the present invention is only defined by the scope of the appended claims.

Further, in the following description of the present invention, a detailed description of known functions and configurations incorporated herein will be omitted when it may make the subject matter of the present invention unclear. Also, the following terms are defined in consideration of the functions of the present invention, and may be differently defined according to the intention of an operator or custom. Therefore, the terms should be defined based on the overall contents of the specification.

Hereinafter, preferred embodiments of the present invention will be described in detail with reference to the accompanying drawings.

Embodiment 1

Figure 1:
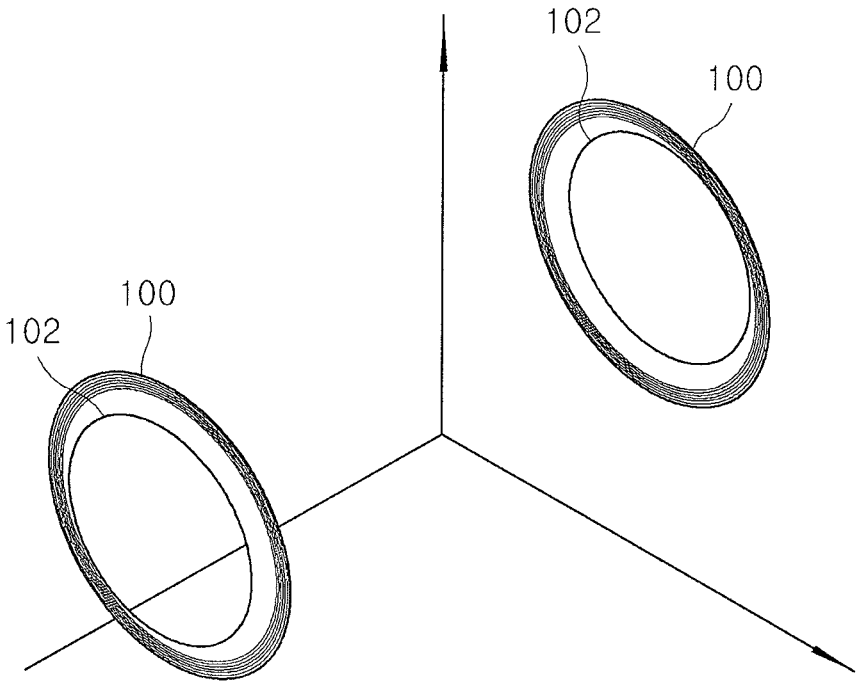
FIG. 1 is a view explaining the structure of an ideal resonator that can be applied to a wireless power transfer system.
Figure 2A:
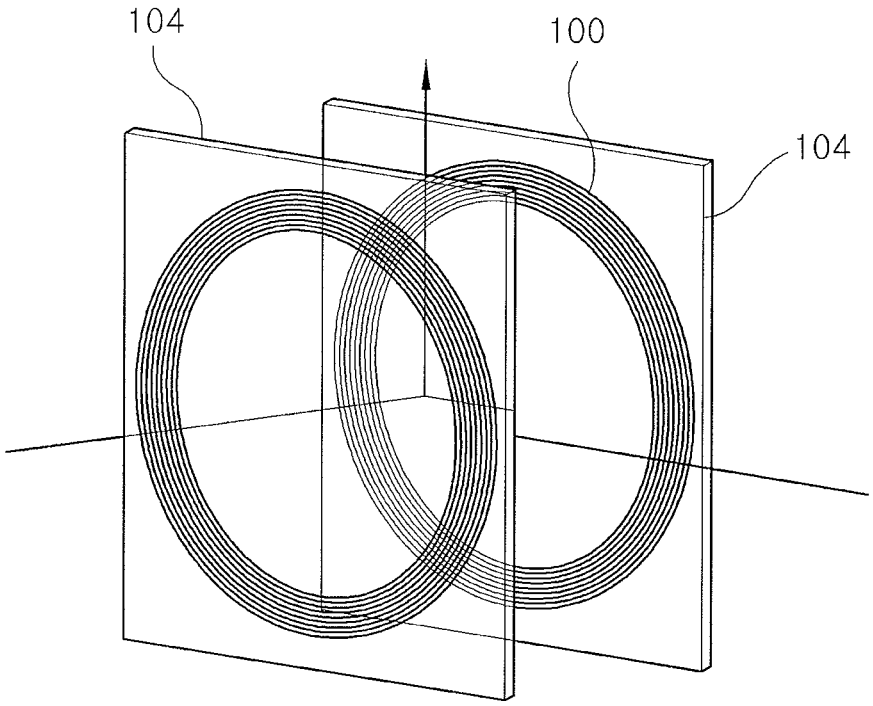
FIGS. 2A to 2C are views showing the shape in which a conductor is fixed to the inside or the surface of a rectangular dielectric substance by processing only the portion where wires are inserted into the dielectric substance according to a method in the related art.
Figure 2B:
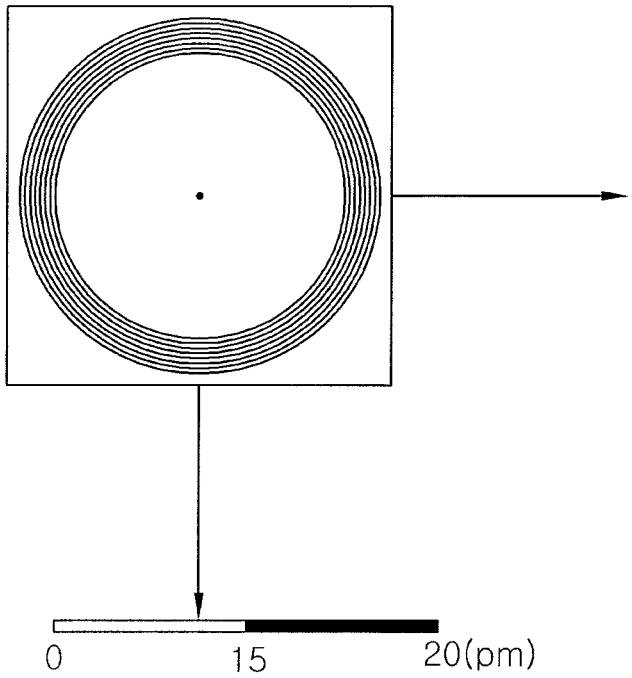
Figure 2C:
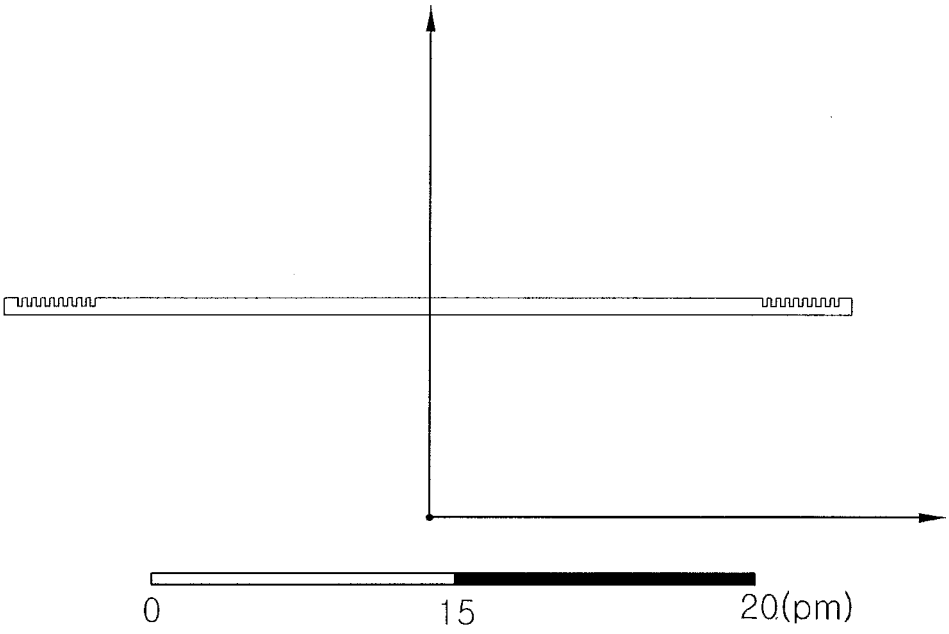
Figure 3A:
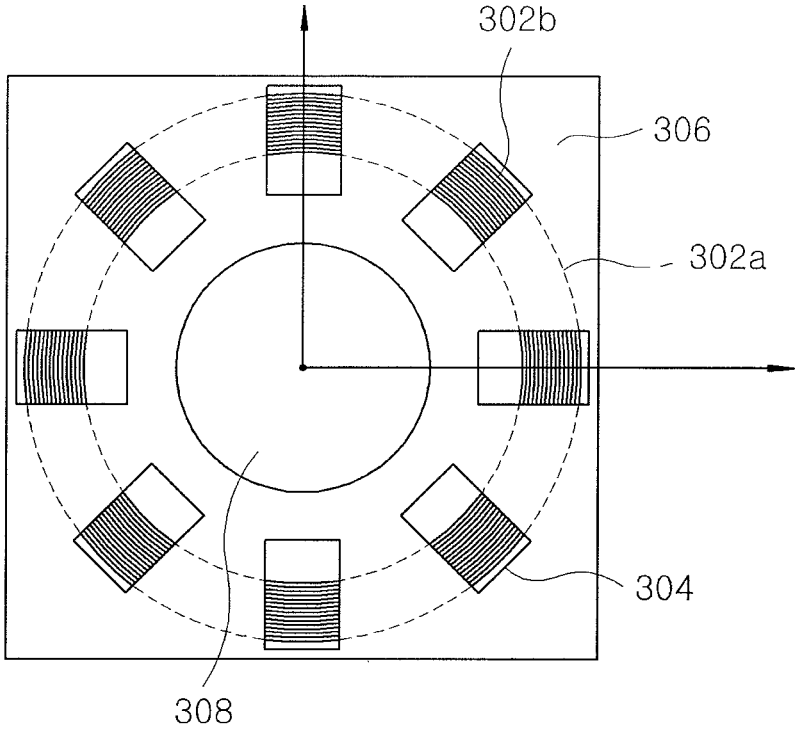
FIGS. 3A and 3B are a plan view and a perspective view, respectively, of a resonator structure for a wireless power transfer system according to an embodiment of the present invention.
Figure 3B:
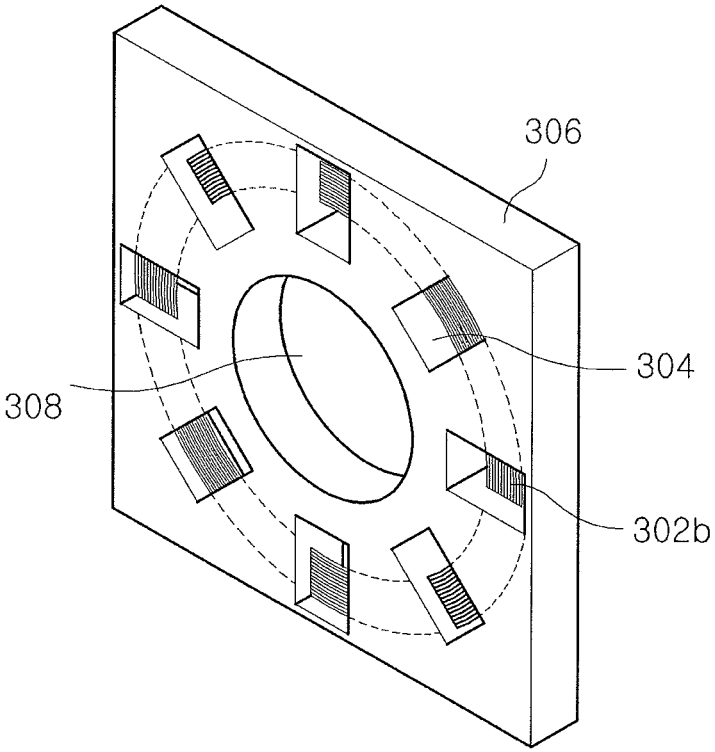

FIG. 3A is a plan view of a resonator structure for a wireless power transfer system according to an embodiment of the present invention, and FIG. 3B is a perspective view thereof.

Referring to FIGS. 3A and 3B, the resonator structure according to this embodiment may include resonators 302*a* and 302*b* for transferring wireless power, and a dielectric substance 306, which includes a plurality of exposure regions 304 formed on the dielectric substance to fix the resonators 302*a* and 302*b* in a covered shape (selectively covered shape) and to selectively expose parts of the resonators 302*a* and 302*b*. Here, the dielectric substance 306 may be defined as a fixture which covers and fixes the resonators 302*a* and 302*b*.

Here, the resonator that is denoted by the reference numeral 302*a* means a resonator portion that is covered by the dielectric substance 306, and the resonator that is denoted by the reference numeral 302*b* means a resonator portion the surface of which is exposed by the respective exposure regions 304.

Further, the resonators 302*a* and 302*b* may be composed of a conductor plate of a circular spiral structure having a predetermined line width and line thickness, and the dielectric substance 306 may have a rectangular structure in which a center cavity 308 of a predetermined size is formed in substantially the center region of a spiral structure. Here, the reason why the center cavity 308 is formed in the center region of the dielectric substance 306 is to reduce the volume of the dielectric substance 306, which exerts an influence on transfer loss. Further, the conductor plate that functions as the resonators 302*a* and 302*b* may be a conductor plate having elasticity.

According to the resonator structure according to this embodiment, parts of the dielectric substance 306 are selectively removed through the plurality of exposure regions 304 that selectively expose parts of the resonators and the center cavity 308, and thus the transfer loss of wireless power can be effectively reduced.

In this embodiment, the resonator is described as having a circular spiral structure. However, the present invention is not limited thereto, and the resonator may have a rectangular spiral structure having a predetermined line width and line thickness.

Embodiment 2

Figure 4A:
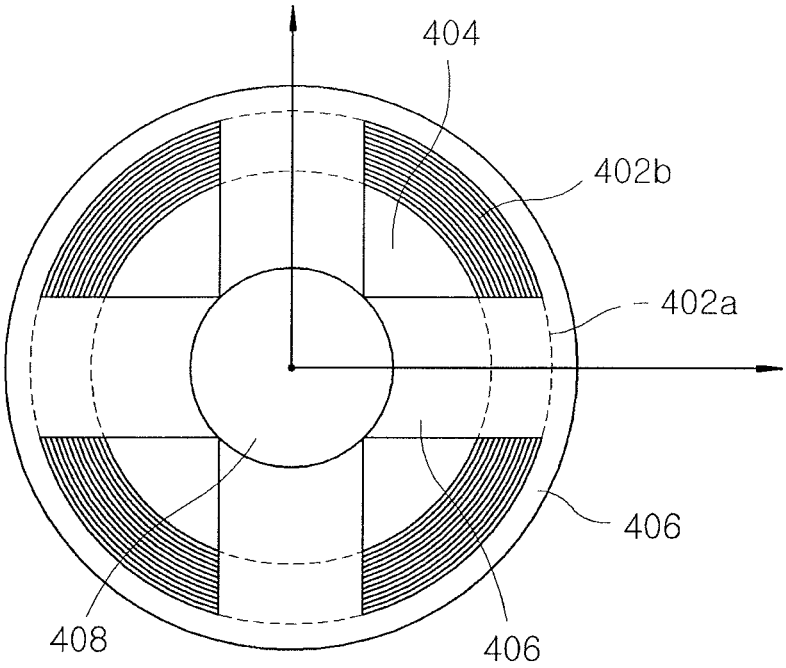
FIGS. 4A and 4B are a plan view and a perspective view, respectively, of a resonator structure for a wireless power transfer system according to another embodiment of the present invention.
Figure 4B:
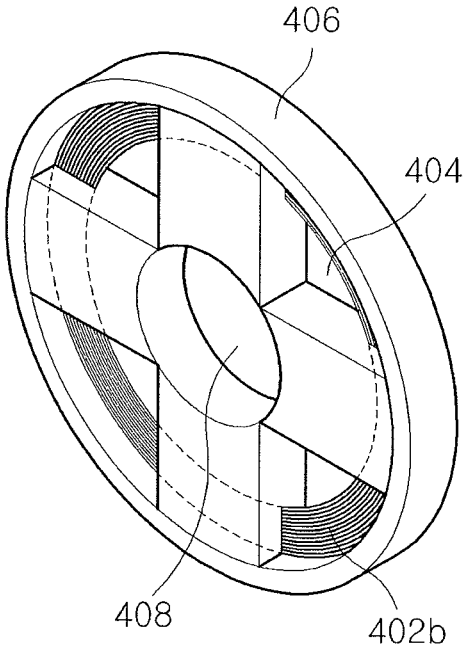

FIG. 4A is a plan view of a resonator structure for a wireless power transfer system according to another embodiment of the present invention, and FIG. 4B is a perspective view thereof.

Referring to FIGS. 4A and 4B, the resonator structure according to this embodiment may include resonators 402*a* and 402*b* for transferring wireless power, and a dielectric substance 406, which includes a plurality of cavities 404 formed in the dielectric substance to fix the resonators 402*a* and 402*b* in a covered shape (selectively covered shape) and to selectively expose parts (or whole surfaces) of the resonators 402*a* and 402*b*. Here, the dielectric substance 406 may be defined as a fixture which covers and fixes the resonators 402*a* and 402*b*.

Here, the resonator that is denoted by the reference numeral 402*a* means a resonator portion that is covered by the dielectric substance 406, and the resonator that is denoted by the reference numeral 402*b* means a resonator portion part of which is exposed by the respective cavities 404.

Further, the resonators 402*a* and 402*b* may be composed of a conductor plate of a circular spiral structure having a predetermined line width and line thickness, and the dielectric substance 406 may have a circular structure in which a center cavity 408 having a predetermined size is formed in substantially the center region of a spiral structure.

That is, the dielectric substance 406 according to this embodiment has a circular structure in a similar manner to the resonators 402*a* and 402*b*, whereas the dielectric substance according to Embodiment 1 described above has a rectangular structure. Accordingly, much more dielectric substance can be removed through the resonator structure according to this embodiment relative to the resonator structure according to Embodiment 1 described above.

Here, the reason why the center cavity 408 is formed in the center region of the dielectric substance 406 is to further reduce the volume of the dielectric substance 406, which exerts an influence on the transfer loss in the same manner as Embodiment 1 described above. Further, the conductor plate, which functions as the resonators 402*a* and 402*b*, may be a conductor plate having elasticity.

According to the resonator structure according to this embodiment, parts of the dielectric substance 406 are selectively removed through the plurality of cavities 404 that selectively expose parts of the resonators, the center cavity 408, and the outer circular structure of the dielectric substance, and thus the transfer loss of wireless power can be effectively reduced.

Embodiment 3

Figure 5A:
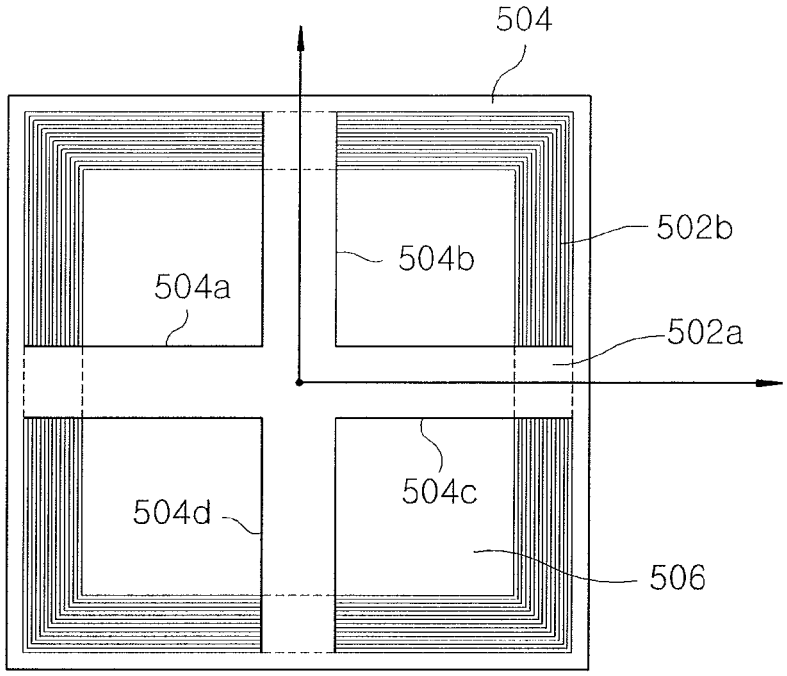
FIGS. 5A and 5B are a plan view and a perspective view, respectively, of a resonator structure for a wireless power transfer system according to still another embodiment of the present invention.
Figure 5B:
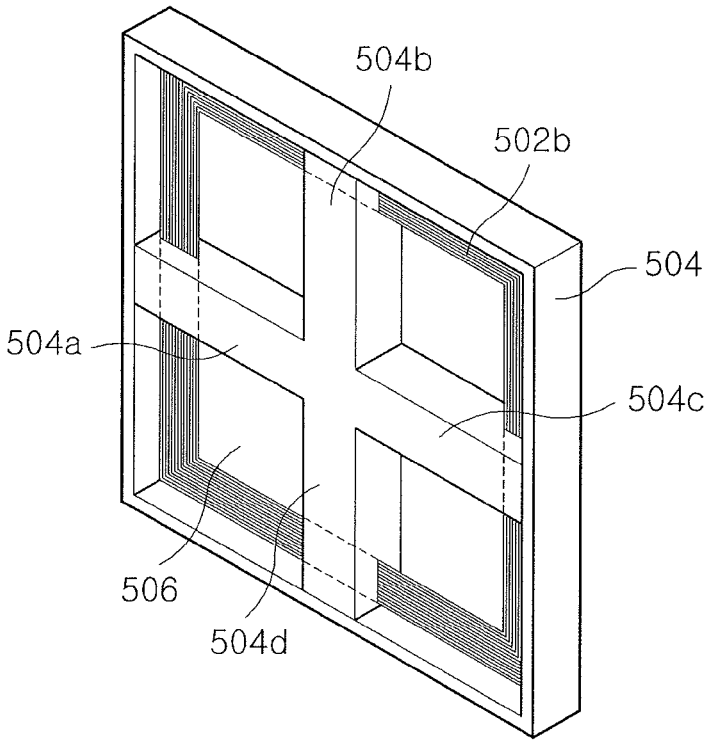

FIG. 5A is a plan view of a resonator structure for a wireless power transfer system according to still another embodiment of the present invention, and FIG. 5B is a perspective view thereof.

Referring to FIGS. 5A and 5B, a resonator structure according to this embodiment may include resonators 502*a* and 502*b*, which are in the form of rectangles to transfer wireless power, and a dielectric substance 504, which includes a plurality of dielectric branches 504*a* to 504*d* that extend in opposite directions (e.g., in upper, lower, left, and right directions) based on the center of the rectangle inside the resonators 502*a* and 502*b* to fix each part of the resonators 502*a* and 502*b* in a covered shape.

Here, the resonator that is denoted by the reference numeral 502*a* means a resonator portion that is covered by the dielectric substance 504, and the resonator that is denoted by the reference numeral 502*b* means a resonator portion the whole surface of which is exposed by a cavity 506.

According to the resonator structure according to this embodiment, the dielectric substance of the remaining regions, other than the plurality of dielectric branches 504*a* to 504*d* that extend (spread) in opposite directions (e.g., in four directions, namely upward, downward, left, and right directions) based on the center of the rectangle inside the resonators 502*a* and 502*b*, is removed as a whole, and thus four cavities 506, the regions of which are divided by the respective dielectric branches 504*a* to 504*d*, are formed.

Further, according to the resonator structure according to this embodiment, the dielectric substance 506 is formed along the outer sides of the rectangular resonators 502*a* and 502*b* to prevent the exposure of the outer sides of the resonators 502*a* and 502*b* to the outside. Through this, a firm fixing structure of the resonators 502*a* and 502*b* can be realized even though only four cavities 506 are formed.

Here, the resonators 502*a* and 502*b* may be composed of a conductor plate of a spiral structure having a predetermined line width and line thickness, and the conductor plate may be a conductor plate having elasticity.

In this embodiment, it is explained that the resonator structure has four dielectric branches and four cavities. However, the present invention is not limited thereto, and the resonator structure may adopt a structure having two dielectric branches extending in left/right or upward/downward direction and two cavities.

Embodiment 4

Figure 6A:
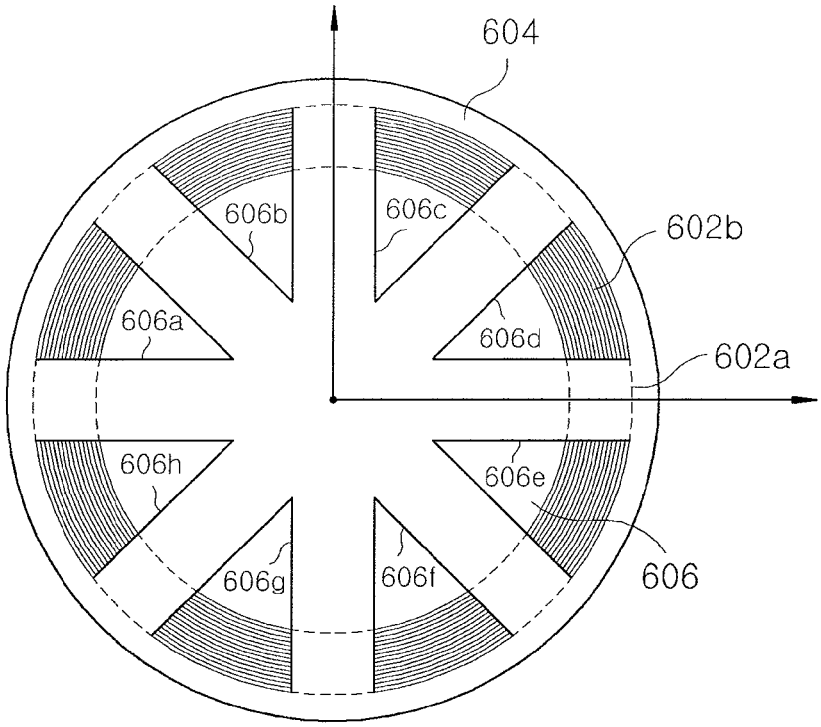
FIGS. 6A and 6B are a plan view and a perspective view, respectively, of a resonator structure for a wireless power transfer system according to yet another embodiment of the present invention.
Figure 6B:
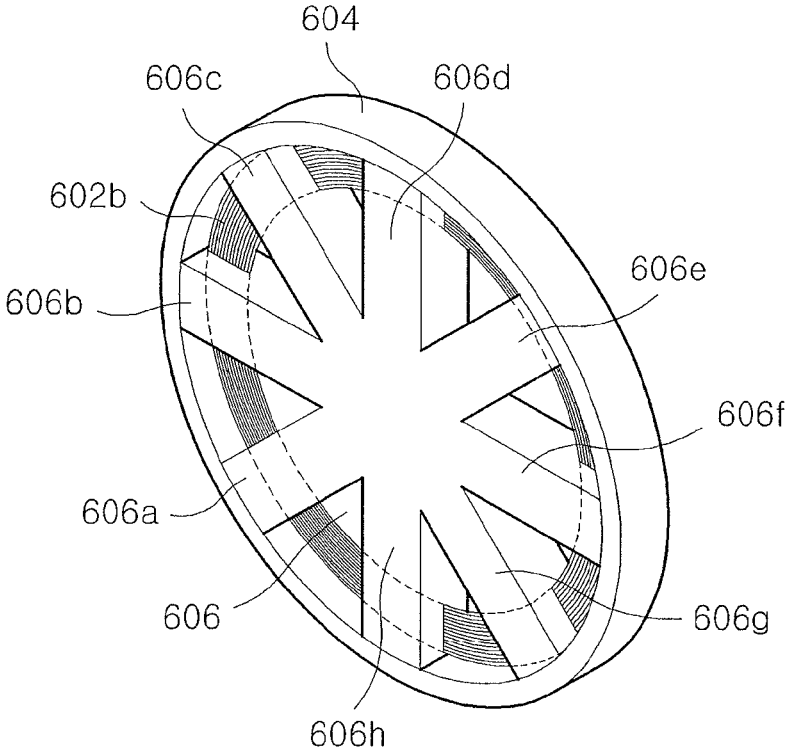

FIG. 6A is a plan view of a resonator structure for a wireless power transfer system according to yet another embodiment of the present invention, and FIG. 6B is a perspective view thereof.

Referring to FIGS. 6A and 6B, the resonator structure according to this embodiment may include resonators 602*a* and 602*b*, which are in the form of circles to transfer wireless power, and a dielectric substance 604, which includes a plurality of dielectric branches 606*a* to 606*h* that extend in outward directions (e.g., in eight directions) based on the center of the circle inside the resonators 602*a* and 602*b* to fix each part of the resonators 602*a* and 602*b* in a covered shape.

Here, the resonator that is denoted by the reference numeral 602*a* means the portion of the resonator that is covered by the dielectric substance 604, and the resonator that is denoted by the reference numeral 602*b* means the portion of the resonator that is exposed by the cavity 606.

According to the resonator structure according to this embodiment, the dielectric substance of the remaining regions, other than the plurality of dielectric branches 606*a* to 606*h* that extend (spread) in outward directions (e.g., in eight directions) based on the center of the circle inside the resonators 602*a* and 602*b*, is completely removed, and thus eight cavities 606, the regions of which are divided by the respective dielectric branches 606*a* to 606*h*, are formed.

Further, according to the resonator structure according to this embodiment, the dielectric substance 604 is formed along the outer sides of the circular resonators 602*a* and 602*b* to prevent the exposure of the outer sides of the resonators 602*a* and 602*b* to the outside. Through this, a firm fixing structure of the resonators 602*a* and 602*b* can be realized even though only eight cavities 606 are formed.

Here, the resonators 602*a* and 602*b* may be composed of a conductor plate having a spiral structure having a predetermined line width and line thickness, and the conductor plate may be a conductor plate having elasticity or a ridge wire that does not have elasticity.

According to the resonators according to this embodiment, in the same manner as, or in a similar manner to, Embodiment 2 described above, a circular center cavity having a predetermined size may be formed in substantially the center region of the dielectric branches in the circle.

Further, in this embodiment, it is explained that the resonator structure has eight dielectric branches and eight cavities. However, the present invention is not limited thereto, and the resonator structure may adopt a structure having three, four, five, or six dielectric branches extending in outward directions and three, four, five, or six cavities that correspond to the dielectric branches.

The description of the present invention as described above is merely exemplary, and it will be understood by those of ordinary skill in the art to which the present invention pertains that various changes in form and detail may be made thereto without changing the technical idea or essential features of the present invention. Accordingly, it will be understood that the above-described embodiments are exemplary in all aspects, and do not limit the scope of the present invention.

Accordingly, the scope of the present invention is defined by the appended claims, and it will be understood that all technical features in the equivalent range fall within the scope of the present invention.

What is claimed is:

1. A resonator structure for a wireless power transfer system, comprising:

a resonator, which is to transfer wireless power; and a dielectric substance to cover the resonator and fix the resonator therein, wherein the dielectric substance includes at least one exposure region to selectively expose at least one portion of the resonator.

2. The resonator structure of claim 1, wherein the resonator has a circular spiral structure.

3. The resonator structure of claim 2, wherein the resonator is a conductor plate having a predetermined line width and line thickness.

4. The resonator structure of claim 2, wherein the dielectric substance has a center cavity which is formed in a center region of the spiral structure.

5. The resonator structure of claim 2, wherein a center cavity is defined entirely through the dielectric substance at a center region of the spiral structure.

6. The resonator structure of claim 1, wherein the resonator has a rectangular spiral structure.

7. The resonator structure of claim 6, wherein the resonator is a conductor plate having a predetermined line width and line thickness.

8. A resonator structure for a wireless power transfer system, comprising:

resonators, which are in a form of a rectangle to transfer wireless power; and a dielectric substance, which includes a plurality of dielectric branches that extend in outward directions based on a center of the rectangle to fix each part of the resonators in a covered form.

9. The resonator structure of claim 8, wherein the plurality of dielectric branches include four dielectric branches which extend in four directions based on the center.

10. The resonator structure of claim 8, wherein the resonator is a conductor plate of a spiral structure having a predetermined line width and line thickness.

11. A resonator structure for a wireless power transfer system, comprising:

resonators, which are in a form of circles to transfer wireless power; and a dielectric substance, which includes a plurality of dielectric branches that extend in diametrically opposed directions based on a center of the circle to fix each part of the resonators in a covered shape.

12. The resonator structure of claim 11, wherein the resonator is a conductor plate of a spiral structure having a predetermined line width and line thickness.

13. The resonator structure of claim 12, wherein the dielectric substance has a circular center cavity which is formed in a center region of the dielectric branches in the circle.

14. The resonator structure of claim 12, wherein the plurality of dielectric branches include eight dielectric branches which extend in eight directions based on the center.

* * * * *